United States Patent [19]

Novak

[11] Patent Number: 4,741,292

[45] Date of Patent: May 3, 1988

[54] ELECTRO-IMPULSE RAPPER SYSTEM FOR BOILERS

[75] Inventor: Paul Novak, Lancaster, Ohio

[73] Assignee: The Babcock & Wilcox Company, New Orleans, La.

[21] Appl. No.: 945,093

[22] Filed: Dec. 22, 1986

[51] Int. Cl.[4] ..... F23J 3/02; F28G 5/00; F28G 7/00

[52] U.S. Cl. ..... 122/379; 165/84; 165/95

[58] Field of Search ..... 122/379; 165/84, 95; 15/104.03, 104.04; 134/16, 166 R, 166 C

[56] References Cited

U.S. PATENT DOCUMENTS

| | | | |
|---|---|---|---|
| 1,953,500 | 4/1934 | Price . | |
| 2,183,496 | 12/1939 | Peters | 165/84 |
| 2,550,676 | 5/1951 | Dalin . | |
| 2,809,615 | 10/1957 | Seidl | 122/379 |
| 3,389,974 | 6/1968 | Barattini et al. . | |
| 3,578,072 | 5/1971 | Kolm | 165/84 |
| 3,672,610 | 6/1972 | Levin . | |
| 3,721,217 | 3/1973 | Willach et al. | 122/379 |
| 3,809,341 | 5/1974 | Levin et al. . | |
| 3,835,817 | 9/1974 | Tuomaala | 122/379 |
| 3,971,343 | 7/1976 | Ulrichi et al. | 122/379 |
| 3,997,000 | 12/1976 | Piela | 122/379 X |
| 4,018,267 | 4/1977 | Tomasicchio | 165/84 |
| 4,077,465 | 3/1978 | Simpson | 165/84 |
| 4,244,749 | 1/1981 | Sachs et al. . | |
| 4,406,323 | 9/1983 | Edelman | 165/84 |
| 4,442,800 | 4/1984 | Seifert et al. | 122/379 |
| 4,457,361 | 7/1984 | Premel et al. | 165/84 |
| 4,458,865 | 7/1984 | Sandorff . | |
| 4,497,282 | 2/1985 | Neundorfer | 122/379 |
| 4,501,319 | 2/1985 | Edelman et al. | 165/84 |
| 4,501,398 | 2/1985 | Sandorff . | |
| 4,595,048 | 6/1986 | Pollak et al. | 165/84 |
| 4,653,578 | 3/1987 | Horning | 122/379 X |

FOREIGN PATENT DOCUMENTS 505433 5/1939 United Kingdom .

OTHER PUBLICATIONS

"Electro-Impulse Deicing Shows Promise", Aviation Week & Space Technology, Jul. 9, 1984.

G. W. Zumwalt, et al., "Flight and Wind Tunnel Tests of an Electro-Impulse De-Icing System", paper given at AIAA/NASA General Aviation Technology Conference, Jul. 10-12, 1984/Hampton, Va.

R. L. Schrag et al., "Electro-Impulse Deicing: Concept and Electrodynamic Studies", paper given at AIAA 22nd Aerospace Sciences Meeting, Jan. 9-12, 1984/Reno, Nev.

*Primary Examiner*—Steven E. Warner

*Attorney, Agent, or Firm*—Harness, Dickey & Pierce

[57] ABSTRACT

A rapper system particularly adapted for removing slag and other encrustations from heat transfer tubes or walls of heat exchanger components. The rapper systems according to this invention employ an electro-impulse type actuator. Linkages couple the heat exchanger components to the actuator such that the actuator exerts simultaneous but opposing forces to the driven surfaces to generate a modal response at the surfaces. Such deflection causes ash encrustations to be removed from the heat exchanger components. According to one embodiment, an elongated cross beam is used with an actuator mounted to it and driving a single connecting rod, whereas other connecting rods are coupled to the cross member. In another embodiment, a pair of cross members are provided which are oriented along skewed axes and drive four or more points on the heat exchanger components. Another embodiment employs pairs of displaced rapper units which are actuated in a timed and phased relationship to generate displacement over large areas of the heat exchanger components.

27 Claims, 4 Drawing Sheets

ELECTRO-IMPULSE RAPPER SYSTEM FOR BOILERS

BACKGROUND OF THE INVENTION

This invention relates to a mechanical actuation system and particularly to one adapted to send high intensity mechanical shock loads to heat exchange surfaces to remove ash encrustations from the heat exchange surfaces.

Heat exchangers used by public utilities and industry are often fired by ash producing fuels. The internal surfaces of the heat exchanger often become fouled with ash encrustation during use. Such fouling adversely affects the heat transfer efficiency of the heat exchanger. Accordingly, it is necessary to provide a system for cleaning the heat exchanger surface.

One system presently in widespread use for deslagging heat exchanger surfaces are so-called sootblowers. These devices have a lance tube with a nozzle at its outer end which projects a fluid medium such as water, steam or air against the fouled surfaces. The thermal shock and mechanical impact caused by the blowing medium break away the slag encrustations from the heat exchanger surfaces. Although sootblowers generally operate satisfactorily and are superior devices in many applications, they have certain limitations. Sootblowers consume a substantial amount of blowing medium which is a direct expense to the operator of the heat exchange facility. Additionally, sootbloweres are unable to reach the areas of the heat exchanger which are inaccessible or beyond the effective range of the discharged blowing medium.

Another method for removing encrustations from heat exchanger surfaces is through the use of mechanical rappers. Conventional rappers have an impactor which through some mechanical linkage strikes a surface within the heat exchanger in order to produce a mechanical vibration which may cause the ash encrustation to disintegrate or loosen its adhesion to the heat exchanger surface.

The higher the acceleration of the structure caused by the rapper, the greater the forces imposed on the slag attached to the structure, causing it to break away. The impulse force versus time history, the locations of the structure which are driven, and the mechanical characteristics of the structure determine the mode of vibration of the structure. Rappers employing direct mechanical impact possess a number of shortcomings. These systems typically cannot be modified to deliver different pulse characteristics to produce the desired mode of resonant vibration in the surface being treated. Existing mechanical rappers further tend to be complicated in construction and may require multiple sources of power. Moreover, direct mechanical impact causes undesirable point loading on the heat exchanger structure and the rapper itself which can lead to structural failure of either.

SUMMARY OF THE INVENTION

The rapper systems in accordance with this invention improve over the present deslagging systems described above. These rappers employ an electro-impulse actuator to generate force impulses. The actuator principally consists of a bank of capacitors, a trigger switch, a low impedance coil, and a target plate. The capacitors are charged by a power supply and are rapidly discharged through the coil by a signal from the trigger switch, thus producing a high intensity magnetic field over a short time duration. The rising and collapsing magnetic field from the coil induces eddy currents in the target plate which generate their own counteracting magnetic fields. These two opposing magnetic fields produce a high repulsive force. The target plate of the actuator is mechanically coupled to a heat exchanger surface where the force pulse excites a mode of vibration of the heat exchanger structure.

The use of electro-impulse actuators enables the heat exchanger structure force input characteristics to be tailored to the requirements of a particular application. Additionally, a number of electro-impulse actuators may be operated by a single controller. In accordance with another feature of this invention, two or more force inputs are applied to the heat exchange structure simultaneously to induce modal response conditions over large regions with a minimum energy input. For example, simultaneous forces acting in opposing directions can be applied to a bank of heat exchanger tubes at displaced locations to excite the structure to respond in the desired mode. By driving the structure at multiple locations, modal response conditions can be generated with lower force inputs than if the system were driven at a single point.

Additional benefits and advantages of the present invention will become apparent to those skilled in the art to which this invention relates from the subsequent description of the preferred embodiments and the appended claims taken in conjunction with the accompanying drawings.

DETAILED DESCRIPTION OF THE INVENTION

Figure 1:
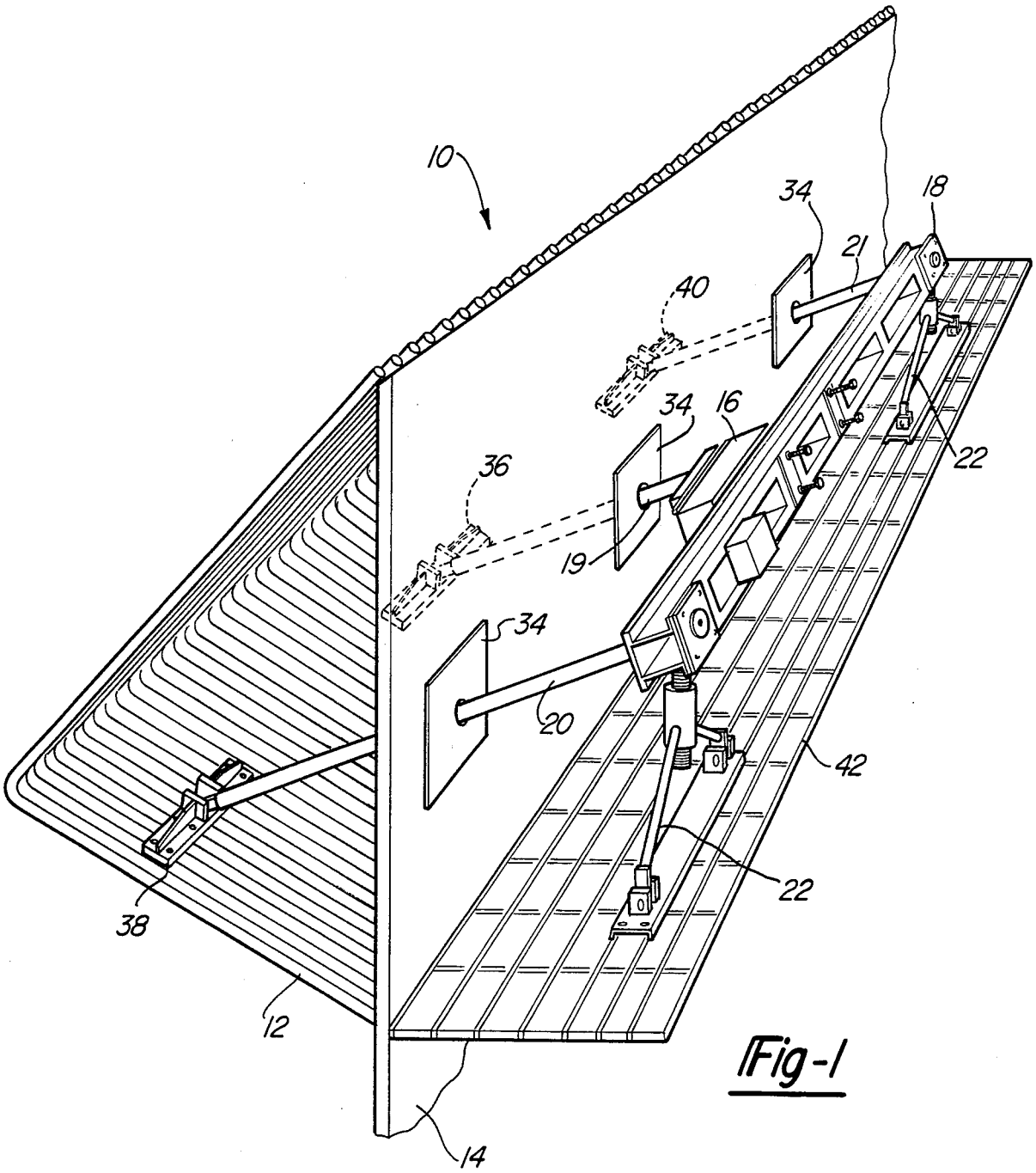
FIG. 1 is a pictorial view of a first embodiment of a rapper according to this invention which is employed to remove slag and other encrustations from heat transfer tubes within the nose section of a boiler.

A rapper in accordance with the first embodiment of this invention is shown in FIG. 1 and is generally designated by reference number 10. Rapper 10 is shown installed to remove slag and encrustations from heat transfer tubes 12 within the nose section of a large-scale utility boiler. Tubes 12 in the nose section diverge from boiler setting 14 as shown in FIG. 1. Tubes 12 are mechanically coupled to one another by bridging members or plates (not shown). Rapper unit 10 is principally comprised of electro-impulse actuator 16, cross beam 18, connecting rods 19, 20, and 21, and mounting brackets 22.

Figure 6:
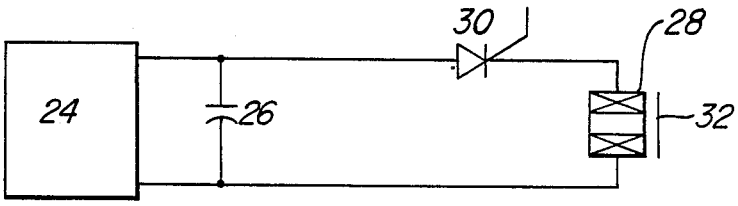
FIG. 6 is an electrical schematic drawing of a circuit for energizing an electro-impulse actuator of the type used in connection with rappers according to this invention.

The principles of operation of electro-impulse actuator 16 are best described with reference to FIG. 6. As shown, a DC power supply 24 is used to charge capacitor 26 (in practice, a bank of capacitors). Coil 28 is connected to capacitor 26 through a trigger 30 such as an SCR. Once capacitor 26 is fully charged, trigger 30 allows a high-voltage pulse to be transmitted to coil 28. This voltage pulse causes current flow within coil 28, thus generating a corresponding rapidly changing magnetic field. This magnetic field acts upon target plate 32 and generates eddy currents within the target plate through induction. These eddy currents produce their own magnetic field which opposes the field generated by coil 28, thus creating a short duration, high magnitude repulsive force between the coil and target plate 32. Controlling the charge on capacitor 26 influences the magnitude of the impulse generated by actuator 16. Pulse width can be controlled by adjusting the impedance of the electrical circuit.

For rapper 10, electro-impulse actuator 16 is mounted at near the midpoint of cross beam 18. The target plate 32 of actuator 16 is coupled to connecting rod 19, which passes through boiler wall port 34. The opposite end of connecting rod 19 is attached to mounting pad 36. The opposing ends of cross beam 18 are connected to connecting rods 20 and 21 which are attached to mounting pads 38 and 40. Like connecting rod 19, connecting rods 20 and 21 pass through boiler wall ports 34. Platform 42 provides a mounting platform for rapper 10. Mounting brackets 22 support the opposing ends of cross beam 18, but permit the cross beam to float, thus de-coupling cross beam 18 from mounting platform 42. Similarly, cross beam 18 may be suspended via a cable and hook from some suitable point, in which case, assemblies 22 are not required.

During operation of rapper 10, an electrical pulse is transmitted to actuator 16. Connecting rod 19, which is coupled to target plate 32, becomes loaded in compression, thereby pushing the tubes 12 to which mounting pad 36 is connected. Cross beam 18 carries the reaction force generated by repulsion of the target plate 32 which is, in turn, transferred to connecting rods 20 and 21. This coupling arrangement causes connecting rods 20 and 21 to become loaded in tension, thus pulling mounting pads 38 and 40 while mounting pad 36 is simultaneously pushed. This simultaneous application of opposing forces generates a desired resonance condition in tubes 12. In order to maximize the cleaning effect of rapper 10, the pulse characteristics of actuator 16 and the placement of mounting pads 36, 38 and 40 are chosen to maximize acceleration of tubes 12.

Since only one connecting rod member 19 is loaded in compression whereas a pair of connecting rods 20 and 21 are loaded in tension, the forces transferred by rods 20 and 21 are less than that transferred by connecting rod 19. In order to achieve a desired vibrational mode, it may be desirable to modify the sizes of the various mounting pads 36, 38 and 40 such that they directly load different numbers of tubes 12.

Figure 2:
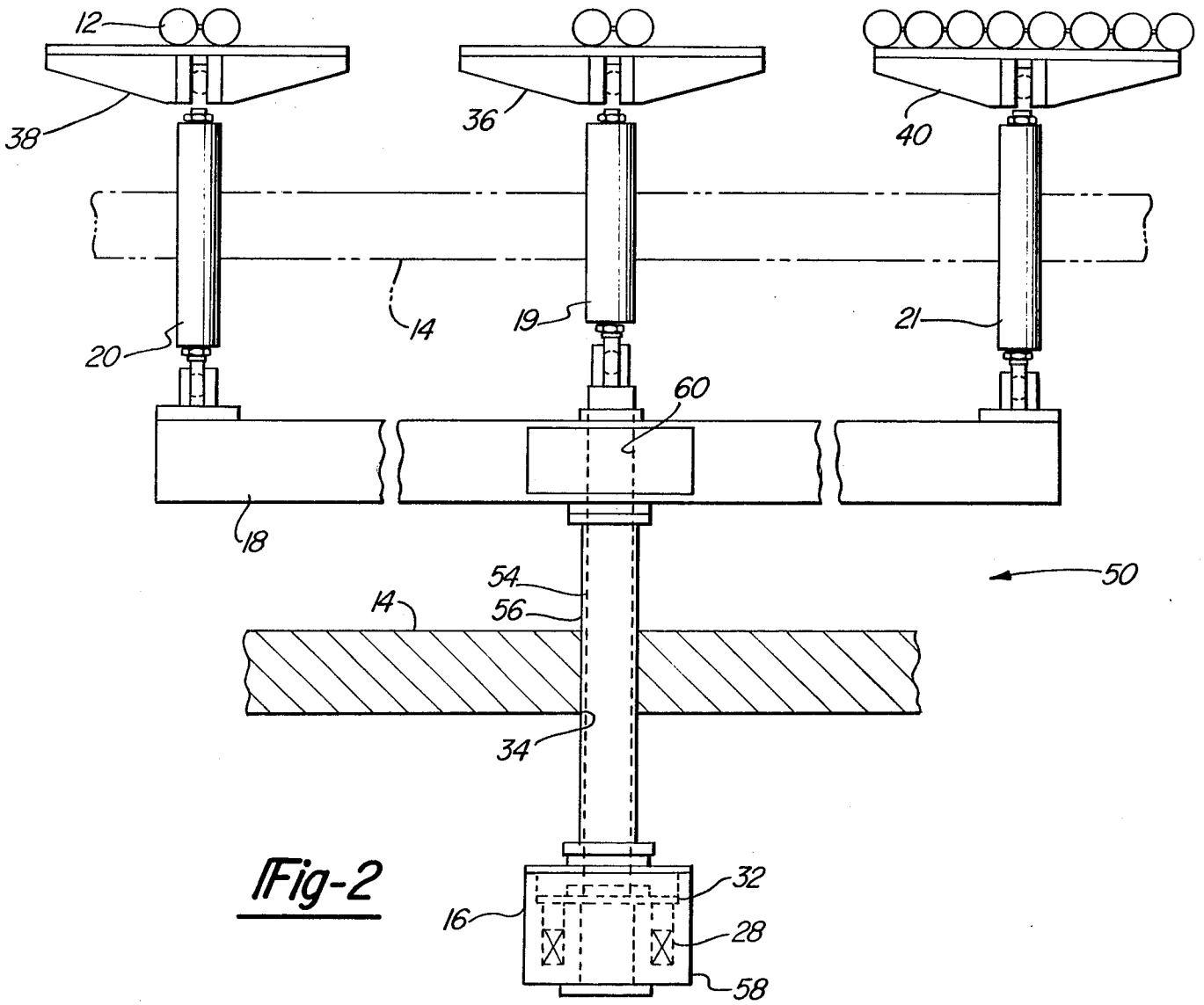
FIG. 2 is a top view of a second embodiment of a rapper similar to FIG. 1 but employs different means for coupling mechanical inputs to the heat transfer tubes.

FIG. 2 illustrates rapper 50 in accordance with a second embodiment of this invention. A number of the elements of rapper 50 are identical to those of rapper 10 and, accordingly, are identified by like reference numbers. For this embodiment, actuator 16 is not mounted directly on cross beam 18. Instead, actuator 16 has rod 54 which passes through bore 60 of cross beam 18, and is coupled to target plate 32 and connecting rod 19. Hollow tube 56 surrounds rod 54 and is coupled to actuator housing 58 and cross beam 18. This embodiment enables actuator 52 to be mounted remotely from cross beam 18, which may be preferred where it is desirable to place actuator 16 remote from the severe environment of the boiler. As shown, boiler setting 14 is shown positioned between cross beam 18 and actuator 16, thus requiring only a single boiler wall port 34. An alternate location for boiler setting 14 is designated by phantom lines in FIG. 2.

During operation of rapper 50, force impulses generated by actuator 16 transmit a compressive force through rod 54 and connecting rod 19. The opposing reaction force is carried by tube 56, cross beam 18 and connecting rods 20 and 21. Accordingly, rapper 50 provides the same simultaneous applications of opposing forces as provided by rapper 10.

Figure 3:
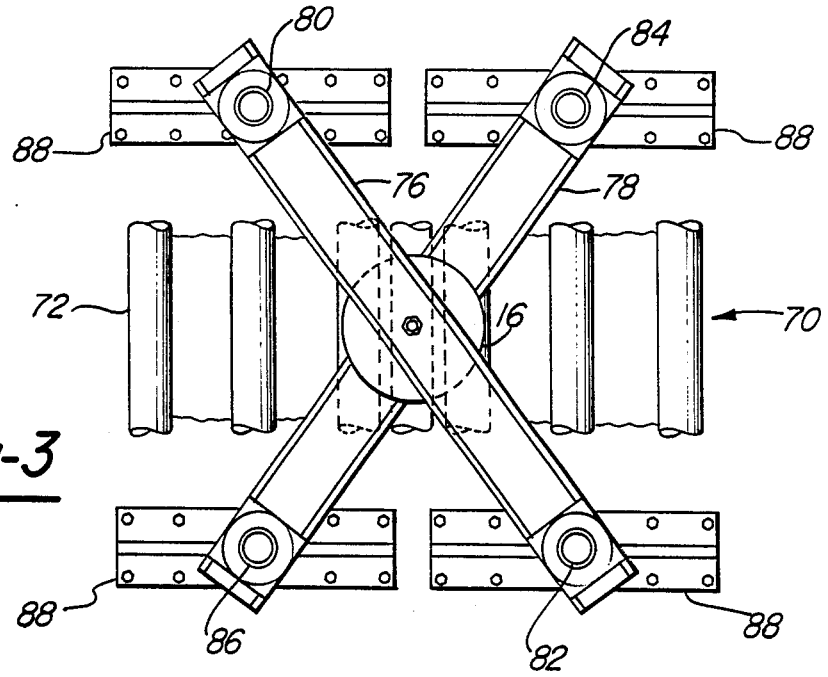
FIG. 3 is a side elevational view of a rapper according to a third embodiment of this invention particularly adapted for removing slag and encrustations from wall tubes of a boiler.
Figure 4:
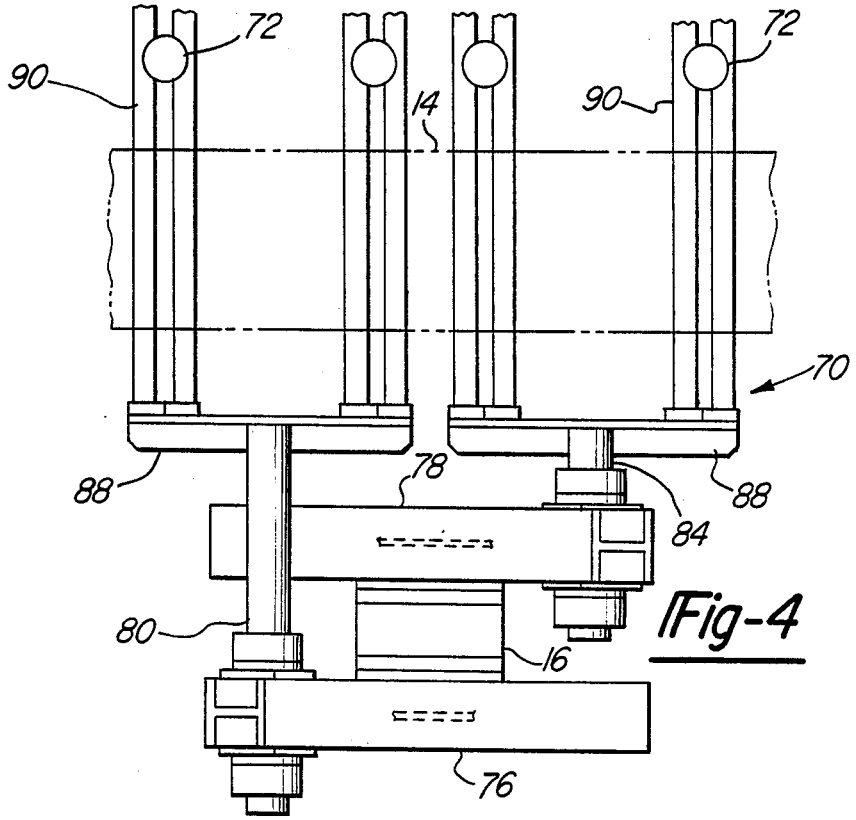
FIG. 4 is a top view of the rapper shown in FIG. 3.

FIGS. 3 and 4 illustrate a third embodiment of a rapper according to this invention which is designated by reference number 70. Rapper 70 is particularly adapted for cleaning wall tubes 72 of a boiler. Rapper 70 includes actuator 16 mounted to cross members 76 and 78. Cross member 76 is coupled to connecting rods 80 and 82, whereas cross member 78 is coupled to connecting rods 84 and 86. Each of the connecting rods is mounted to mounting plates 88. Mounting plates 88 may be mounted directly to wall tubes 72 as shown in FIG. 3 or the forces may be applied to the tubes by clamp bars 90 which pass through the boiler setting as shown in FIG. 4.

When actuator 16 produces a mechanical pulse, cross member 78 exerts a compressive loading on connecting rods 84 and 86. The reaction force is carried by cross member 76 which produces a tension load in connecting rods 80 and 82. Therefore, like the previously described rappers, rapper 70 exerts simultaneous opposing forces on the boiler structure. Since connecting rods 80, 82, 84, and 86 contact the boiler setting (or tubes) at points which define a plane, actuation of rapper 70 generates deflections along both vertical and horizontal axes. This characteristic enables rapper 70 to cause deflection over large areas. In order to achieve the desired vibrational modes, the angle of intersection and/or the lengths of cross beams 76 and 78 may be varied.

Figure 5:
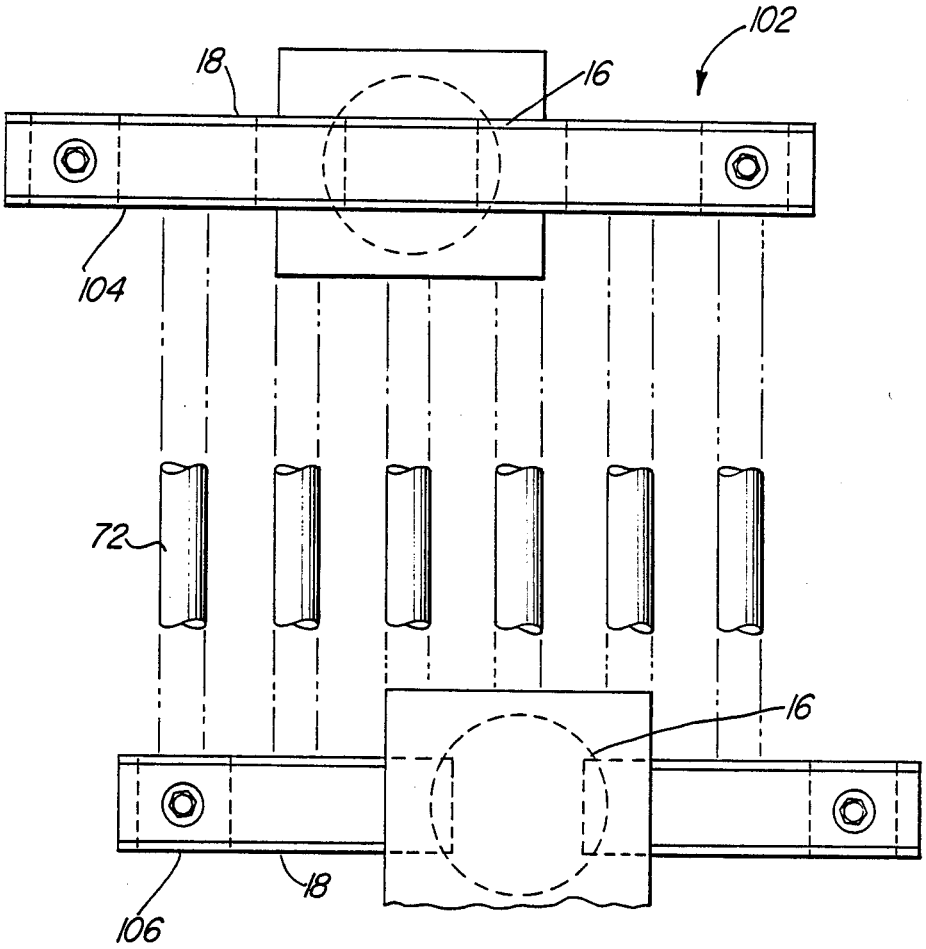
FIG. 5 is a side elevational view of a rapper system according to a fourth embodiment of this invention employing a pair of displaced rapper mechanisms.

FIG. 5 illustrates a rapper system in accordance with a fourth embodiment of this invention which is designated by reference number 102. Rapper system 102 includes a pair of separate rapper units 104 and 106 which are displaced and mounted to boiler tubes 72. Rapper system 102 is particularly adapted for cleaning pendant tube bundles within a boiler which are suspended from above and hang into the boiler interior. Rapper units 104 and 106 may be of any type but are shown for the sake of illustration as being identical to rapper 10 described above. Each of rapper units 104 and 106 includes actuator 16 which acts on cross beam 18 and the associated connecting rods. Rapper units 104 and 106 are controlled such that they provide pulses in a timed and phased relationship such that their mechanical inputs reinforce each other to accelerate large portions of the boiler structure. Rapper units 104 and 106 are mechanically coupled only through the boiler structure and are not otherwise physically connected.

Rapper system 102 may also be implemented such that the mechanical inputs from individual rapper units 102 and 104 do not reinforce each other in a particular response mode, but instead drive the structure into different response modes. Generally speaking, when a structure resonates, the pattern of deflection defines so-called nodes and anti-nodes, corresponding to areas of minimum and maximum deflection (and acceleration), respectively. Certain boiler regions may not experience sufficient acceleration to achieve ash removal when a single rapper drives the structure in a particular response mode. Accordingly, another rapper unit may be employed to drive the structure in a different response mode, or may drive the structure such that the areas of maximum and minimum deflection are repositioned to thereby provide adequate ash removal.

While the above description constitutes the preferred embodiments of the present invention, it will be appreciated that the invention is susceptible to modification, variation and change without departing from the proper scope and fair meaning of the accompanying claims.

What is claimed is:

1. A rapper for inducing modal response conditions in portions of heat exchanger components to remove ash encrustations from said components, comprising:

an electro-impulse actuator having first and second mounting points, said actuator generating a mechanical impulse through displacement between said mounting points when an electrical pulse is applied to said actuator, a first coupling means for mechanically coupling said first actuator mounting point to said heat exchanger components at one or more first driving location wherein at least a portion of said first coupling means is loaded in tension when said electrical pulse is applied to said actuator, and a second coupling means for mechanically coupling said second actuator mounting point to said heat exchanger components at one or more second driving location wherein at least a portion of said second coupling means is loaded in compression when said electrical pulse is applied to said actuator, said first and second driving locations being displaced and mechanically coupled to each other through said heat exchanger components, whereby said first and second coupling means simultaneously exert opposing forces on said heat exchanger components such that responses are produced at said first driving location which reinforce the responses produced at said second driving location, and wherein said responses at said first and second driving location drive said heat exchanger components into oscillation thus deflecting said components which cause said encrustation to be removed.

2. The rapper according to claim 1 wherein said first coupling means comprises a first beam coupled at near its midpoint to said actuator first mounting point and having at least two rods affixed to said first beam at near its ends and coupled to said heat exchanger components, and said second coupling means comprises a second beam coupled at near its midpoint to said actuator second mounting point and having at least two rods affixed to said second beam at near its ends and coupled to said heat exchanger components, said first and second beams oriented along non-parallel axes.

3. A rapper according to claim 1 further comprising mounting means for said actuator for decoupling impulses of said actuator from the stationary structure of said heat exchanger.

4. The rapper according to claim 1 wherein said first coupling means comprises an elongated beam with said actuator first mounting point coupled to said beam at near the longitudinal midpoint thereof, and at least two rods affixed to said beam and coupled to said heat exchanger components, and wherein said second coupling means comprises at least one rod coupled to said second actuator mounting point and to said heat exchanger components.

5. The rapper according to claim 4 wherein said actuator first mounting point is affixed to said beam, and wherein a rod is affixed to said cross beam at near the opposite ends thereof.

6. The rapper according to claim 4 wherein said first coupling means further comprises an elongated hollow tube connected to said beam and said actuator first mounting point and said second coupling means further comprises a member coupled to said second coupling means rod and said actuator second mounting point, said member disposed co-axially within said tube.

7. A rapper for inducing modal response conditions in portions of heat exchangers to remove ash encrustations from said heat exchangers, comprising;

an electro-impulse actuator having first and second mounting points, said actuator causing displacement between said mounting points when an electrical pulse is applied to said actuator, an elongated beam with said actuator first mounting point coupled to said beam at near its midpoint, at least one rod affixed to said beam and to said heat exchanger, and at least one rod coupled to said actuator second mounting point and to said heat exchanger, said rods driving said heat exchanger at at least two separated driving points which are mechanically coupled to each other through said heat exchanger components, thereby causing deflection of said heat exchanger such that responses are produced at said first driving location which reinforce the responses produced at said second driving location, and wherein said responses at said first and second driving location drive said heat exchanger components into oscillation, thus deflecting said components which cause said encrustation to be removed.

8. The rapper according to claim 7 wherein said actuator first mounting point is affixed to said cross beam.

9. The rapper according to claim 7 further comprising, an elongated hollow tube affixed to said actuator first mounting point and said cross beam and a shaft coupled to said actuator second mounting point, said shaft disposed co-axially within said tube.

10. A rapper according to claim 7 further comprising mounting means for said actuator for decoupling impulses of said actuator from the stationary structure of said heat exchanger.

11. The rapper according to claim 7 wherein a pair of rods are affixed to said cross beam with one of said rods attached at each end thereof.

12. The rapper according to claim 11 wherein said rods are coupled to said heat exchanger along a straight line.

13. A rapper for inducing modal response conditions in portions of heat exchanger components to remove ash encrustations from said components, comprising:

an electro-impulse actuator having first and second mounting points, said actuator causing displacement between said mounting points when an electrical pulse is applied to said actuator, a first coupling means for mechanically coupling said first actuator mounting point to said heat exchanger components at one or more first drivig location wherein at least a portion of said coupling means is loaded in tension when said electrical pulse is applied to said actuator, said first coupling means comprising an elongated beam with said actuator first mounting point affixed to said beam at near the longitudinal midpoint thereof, and at least two rods affixed to said beam at near the opposite ends thereof and coupled to said heat exchanger components, and a second coupling means for mechanically coupling said second actuator mounting point to said heat exchanger components at one or more second driving location wherein at least a portion of said second coupling means is loaded in compression when said electrical pulse is applied to said actuator and wherein said coupling means comprises at least one rod coupled to said second actuator mounting point and to said heat exchanger components, said first and second driving locations being displaced, whereby said first and second coupling means simultaneously exert opposing forces on said heat exchanger components.

14. A rapper for inducing modal response conditions in portions of heat exchanger components to remove ash encrustations from said components, comprising:

an electro-impulse actuator having first and second mounting points, said actuator causing displacement between said mounting points when an electrical pulse is applied to said actuator, a first coupling means for mechanically coupling said first actuator mounting point to said heat exchanger components at one or more first driving location wherein at least a portion of said first coupling means is loaded in tension when said electrical pulse is applied to said actuator, said first coupling means comprises an elongated beam with said actuator first mounting point coupled to said beam at near the longitudinal midpoint thereof, and at least two rods affixed to said beam and coupled to said heat exchanger components, and a second coupling means for mechanically coupling said second actuator mounting point to said heat exchanger components at one or more second driving location wherein at least a portion of said second coupling means is loaded in compression when said electrical pulse is applied to said actuator and wherein said second coupling means comprises at least one rod coupled to said second actuator mounting point and to said heat exchanger components, said first and second driving locations being displaced, whereby said first and second coupling means simultaneously exert opposing forces on said heat exchanger components.

15. A rapper for inducing modal response conditions in portions of heat exchanger components to remove ash encrustations from said components, comprising:

actuator means having first and second mounting points, said actuator for generating a mechanical impulse through displacement between said mounting points when a control signal is applied to said actuator means, a first coupling means for mechanically coupling said first actuator mounting point to said heat exchanger components at one or more first driving location wherein at least a portion of said first coupling means is loaded in tension when said control signal is applied to said actuator, and a second coupling means for mechanially coupling said second actuator mounting point to said heat exchanger components at one or more second driving location wherein at least a portion of said second coupling means is loaded in compression when said control signal is applied to said actuator, said first and second driving locations being displaced and mechanically coupled to each other through said heat exchanger components, whereby said first and second coupling means simultaneously exert opposing forces on said heat exchanger components such that responses are produced at said first driving location which reinforce the responses produced at said second driving location, and wherein said responses at said first and second driving location drive said heat exchanger components into oscillation thus deflecting said components which cause said encrustation to be removed.

16. A rapper according to claim 15 further comprising mounting means for said actuator for decoupling impulses of said actuator from the stationary structure of said heat exchanger.

17. The rapper according to claim 15 wherein said first coupling means comprises an elongated beam with said actuator first mounting point coupled to said beam at near the longitudinal midpoint thereof, and at least two rods affixed to said beam and coupled to said heat exchanger components, and wherein said second coupling means comprises at least one rod coupled to said second actuator mounting point and to said heat exchanger components.

18. The rapper according to claim 17 wherein said actuator first mounting point is affixed to said beam, and wherein a rod is affixed to said cross beam to near the opposite ends thereof.

19. The rapper according to claim 17 wherein said first coupling means further comprises an elongated hollow tube connected to said beam and said actuator first mounting point, and said second coupling means further comprises a member coupled to said second coupling means rod and said actuator second mounting point, said member disposed co-axially within said tube.

20. The rapper according to claim 17 wherein said first coupling means comprises a first beam coupled at near its midpoint to said actuator first mounting point and having at least two rods affixed to said first beam at near its ends and coupled to said heat exchanger components, and said second coupling means comprises a second beam coupled at near its midpoint to said actuator second mounting point and having at least two rods affixed to said second beam at near its ends and coupled to said heat exchanger components.

21. The rapper according to claim 20 wherein said first and second beams are oriented along non-parallel axes.

22. A rapper for inducing modal response conditions in portions of heat exchangers to remove ash encrustations from said heat exchangers, comrising;

actuator means having first and second mounting points, said actuator for generating a mechanical impulse through displacement between said mounting points when a control signal is applied to said actuator means, an elongated beam with said actuator first mounting point coupled to said beam at near its midpoint, at least one rod affixed to said beam and to said heat exchanger, and at least one rod coupled to said actuator second mounting point and to said heat exchanger, said rods driving said heat exchanger at at least two separated driving points which are mechanically coupled to each other through said heat exchanger components, thereby causing deflection of said heat exchanger such that responses are produced at said first driving location which reinforce the responses produced at said second driving location, and wherein said responses at said first and second drivig location drive said heat exchanger components into oscillation thus deflecting said components which cause said encrustation to be removed.

23. A rapper according to claim 22 further comprising mounting means for said actuator for decoupling impulses of said actuator from the stationary structure of said heat exchanger.

24. The rapper according to claim 22 wherein said actuator first mounting point is affixed to said cross beam.

25. The rapper according to claim 22 further comprising, an elongated hollow tube affixed to said actuator first mounting point and said cross beam and a shaft coupled to said actuator second mounting point, said shaft disposed co-axially within said tube.

26. The rapper according to claim 22 wherein a pair of rods are affixed to said cross beam with one of said rods attached at each end thereof.

27. The rapper according to claim 26 wherein said rods are coupled to said heat exchanger along a straight line.

* * * * *

UNITED STATES PATENT AND TRADEMARK OFFICE

CERTIFICATE OF CORRECTION

PATENT NO. : 4,741,292

DATED : May 3, 1988

INVENTOR(S) : Paul Novak

It is certified that error appears in the above-identified patent and that said Letters Patent is hereby corrected as shown below:

ON THE TITLE PAGE,
under "References Cited - U.S. Patent Documents", 3,971,343, "Ulrichi et al" should be --Ulrich et al--.

Column 1, lines 40-41, "heat exchanger" should be --boiler--.

Column 6, line 66, Claim 13, "drivig" should be --driving--.

Column 6, line 67, Claim 13, after "said" insert --first--.

Column 7, line 14, Claim 13, after "said" insert --second--.

Column 7, line 34, Claim 14, "comprises" should be --comprising--.

Column 7, line 66, Claim 15, "mechanially" should be --mechanically--.

Column 8, line 55, Claim 22, "comrising" should be --comprising--.

Column 9, line 7, Claim 22, "drivig" should be --driving--.

Signed and Sealed this

Thirteenth Day of December, 1988

*Attest:*

DONALD J. QUIGG

*Attesting Officer*

*Commissioner of Patents and Trademarks*